US005979682A

United States Patent [19]

Zumbuhl

[11] Patent Number: 5,979,682

[45] **Date of Patent: *Nov. 9, 1999**

[54] TAB CONSTRUCTION FOR CLOSURES HAVING TAMPER EVIDENT RINGS

[76] Inventor: Bruno Zumbuhl, 1801 N. Kentucky Ave., Evansville, Ind. 47711

[ * ] Notice: This patent is subject to a terminal disclaimer.

[21] Appl. No.: 08/961,235

[22] Filed: Oct. 30, 1997

Related U.S. Application Data

[60] Provisional application No. 60/043,687, Apr. 14, 1997.

[51] Int. Cl.[6] ..... B65D 41/34

[52] U.S. Cl. ..... 215/252

[58] Field of Search ..... 215/252, 250, 215/253, 258, 901

[56] References Cited

U.S. PATENT DOCUMENTS

| | | | |
|---|---|---|---|
| 4,488,655 | 12/1984 | Itsudo et al. . | |
| 4,744,480 | 5/1988 | Luch et al. . | |
| 4,784,280 | 11/1988 | Breuer et al. | 215/252 |
| 4,938,370 | 7/1990 | McBride . | |
| 4,978,017 | 12/1990 | McBride . | |
| 5,050,753 | 9/1991 | Trump et al. | 215/253 X |
| 5,086,938 | 2/1992 | Aichinger | 215/252 |
| 5,107,998 | 4/1992 | Zumbuhl . | |
| 5,167,335 | 12/1992 | McBride et al. . | |
| 5,328,044 | 7/1994 | Rohrs et al. | 215/252 |
| 5,356,019 | 10/1994 | Kelly . | |
| 5,533,633 | 7/1996 | King . | |
| 5,648,037 | 7/1997 | Franchet . | |
| 5,676,269 | 10/1997 | Blake et al. | 215/252 |
| 5,680,945 | 10/1997 | Sander et al. | 215/252 |
| 5,755,346 | 5/1998 | Ekkert | 215/252 |
| 5,829,612 | 11/1998 | Zumbuhl | 215/252 |

*Primary Examiner*—Stephen K. Cronin
*Assistant Examiner*—Nathan Newhouse
*Attorney, Agent, or Firm*—Charles E. Temko

[57] ABSTRACT

A threaded type tamper-indicating closure in which the tamper-indicating ring is separated from the cap element of the closure as the closure is opened, in which the tabs which contact an undersurface of a bead on the outer surface of an engaged container finish are prevented from flexing radially inwardly beyond a limited degree so as to assure that the tabs will function immediately as the closure commences unthreading. In some of the disclosed embodiments, this is accomplished by positioned the pivot axis of the tabs either radially inwardly of the inner edge of the tabs when they are in relatively unstressed condition, or in a common vertical plane therewith, so that the tabs pivot radially outwardly as they come into contact with the bead. In other embodiments, the tabs are of sufficient axial length that they contact the outer surface of the container finish before substantial pivoting occurs. In still another embodiment, the tamper-indicating ring includes an upper wall member of relatively reduced thickness to enable both bending and flexing radially outwardly during installation to enable relatively rigid tabs to clear a radially outwardly extending bead on the container neck or finish. The tabs extend radially inwardly from an upper edge of a relatively thicker lower wall member of the tamper-indicating ring, and do not substantially bend or flex relative to the lower wall member during either installation or removal.

13 Claims, 9 Drawing Sheets

FIG. 9
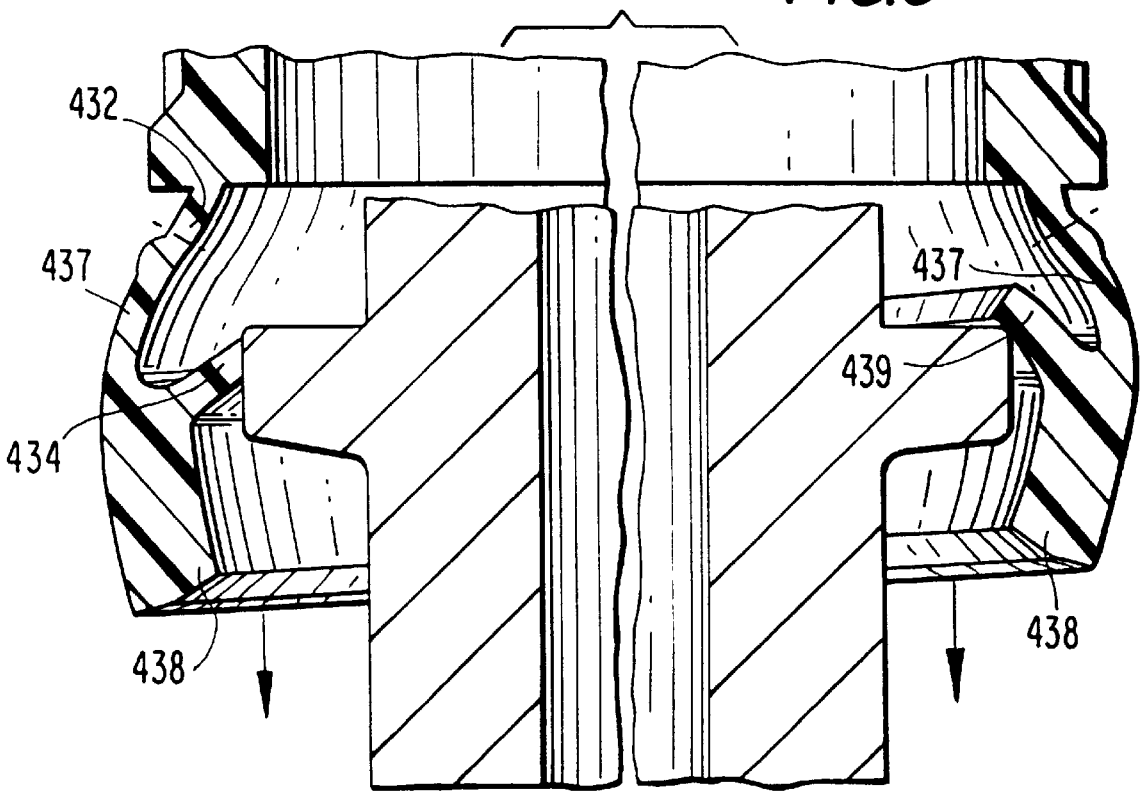
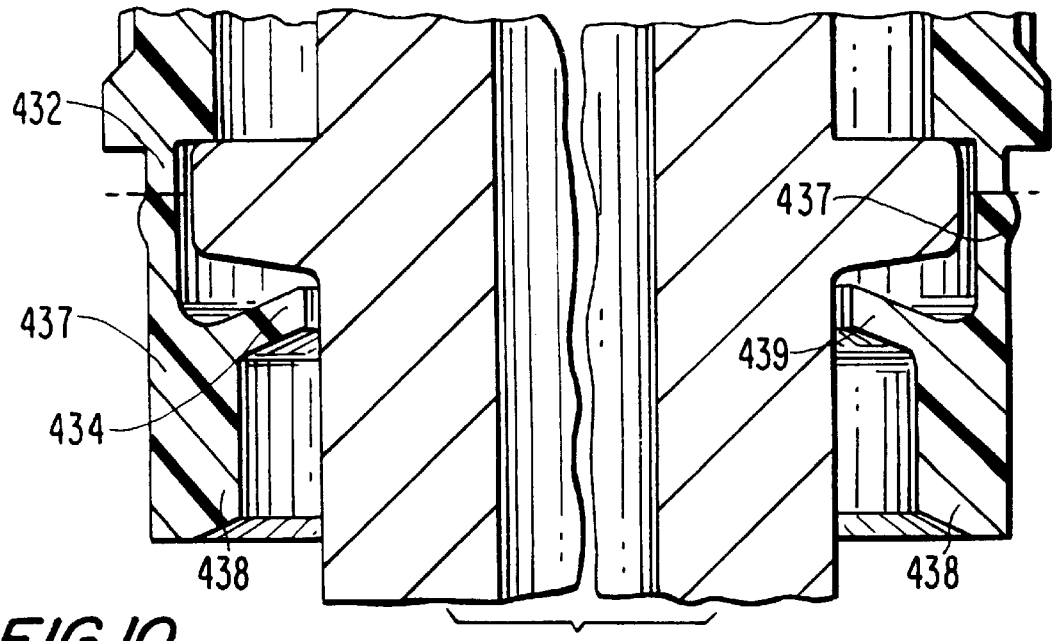
FIG. 10

TAB CONSTRUCTION FOR CLOSURES HAVING TAMPER EVIDENT RINGS

This application claims the benefit of U.S. provisional application No. 60/043,687, filed Apr. 14, 1997.

BACKGROUND OF THE INVENTION

This invention relates generally to the field of threaded closures for containers, and more particularly to synthetic resinous closures of relatively small diameter employed to seal containers of pressurized contents, typically, soft drinks, beer and other carbonated comestibles. Traditionally, such containers have been sealed using metallic caps commonly referred to as crown closures requiring the use of a tool for removal. Over the past fifteen to twenty years, such closures have been almost completely replaced by a synthetic resinous threaded closure, either injection molded, or more commonly, compression molded. Such closures are usually provided with a tamper-evident ring which depends from the lower edge of the cylindrical side wall of the closure, and is interconnected to said edge by frangible bridges formed during the molding operation, or by a separate slitting operation. Annual production of said closures surpasses that of most other types of closures, and not surprisingly, the art relating to such closures is in a highly developed state.

Although synthetic resinous closures of this type have many advantages, including the ability to be removed without the use of a tool, and the ability to reseal the container where all of the contents are not consumed upon first opening, they do present significant problems during manufacture and operation.

A serious problem lies in the provision of frangible ribs or bridges which interconnect the lower edge of the side wall or skirt of the closure with the tamper-indicating band or ring. The bridges must be sufficiently strong so as to avoid breaking when the closures are installed, either by threading or pressing the closures into position, and yet be capable of readily fracturing when the closure is unthreaded. To this end, designs have included the provision of some bridge members which are stronger than other bridge members, and are positioned in specific locations, this construction being partially successful where the tamper-evident ring is split and remains attached to the skirt of the closure during the removal of the same. Other constructions provide for a camming action utilizing inclined surfaces at the lower edge of the skirt and the lower edge of the tamper-indicating ring.

The most common construction used for fracturing the bridges when the closure is removed involves the use of flexible wings or tabs. One form uses tabs which engage the outer surface of the finish of the container to prevent rotation of the ring relative to the skirt. More commonly, the tabs are pivoted about an axis normal to the axis of the closure and have free ends which engage beneath a radially projecting bead on the outer surface of the container finish. The tabs are not only pivoted relative to the inner surface of the ring, but are flexible as well to permit easy removal without damage from a forming mold. The relatively thin cross section required to produce this flexibility has an adverse result in that the tabs are occasionally not sufficiently rigid to assure prompt breakage of the bridges when the closure is unthreaded. This problem is accommodated by the provision of a radially inwardly extending band on the inner surface of the ring against which the tabs are engaged after being progressively folded or flexed through approximately 135 degrees. This engagement reduces the effective diameter of the bead on the tamper-indicating ring to less than that of the corresponding bead on the outer surface of the container, so that it cannot pass the bead on the container, and continued unthreading of the closure serves to break the bridges. The use of this construction is almost mandatory where the bridges are of unequal strength. However, this construction in its so-called "second model" of operation requires a substantial degree of unthreading of the closure before the bridges are broken, and no substantial leverage is obtained during such operation.

Closures which operate only in the first mode are preferable, but the use of these closures has not been without complications unless they are used with containers having finishes which are manufactured to very close dimensional tolerances. In some cases, the closures will perform satisfactorily with containers made from a particular synthetic material, and not with containers made from a similar synthetic material of different durometer value. In third world countries, where the use of glass containers which are recycled is common, initial manufacturing tolerances are often not carefully maintained, and are further diminished, each time the container is recycled, As a result, closures designed to operate in the first mode will, in some cases, operate in the second mode because of excessive clearances between the tabs and the outer surface of the container finish below the tab-engaging bead.

BRIEF DESCRIPTION OF THE PRIOR ART

In my prior U.S. Pat. No. 5,107,988 of Apr. 28, 1992 there is disclosed a tab construction in which the tabs are of sufficiently thick cross section to preclude the possibility of flexing as described to provide a purely pivotal movement about an axis perpendicular to the principal axis of the closure formed by an area of relatively thin cross section where the tabs are pivotally interconnected to the inner surface of the tamper-indicating ring. The tabs, in relatively unstressed condition extend radially inwardly at approximately a 30 degree angle with respect to the principal axis of the closure, and are generally polygonal in cross section. When the closure is unthreaded, upon contact with a lower surface on the corresponding ring on the container neck, they will pivot to an additional 19–20 degrees, thus providing additional leverage to break the tamper ring bridges as the closure is progressively unthreaded. Thus, the tabs operate in only a single mode in which they are in relatively upright position.

While not without substantial utility, I have determined that when closures are made in accordance with this construction, the use of synthetic resinous materials lacking sufficient tensile strength sometimes permits excessive enlargement of the tamper-indicating rings to a degree which may permit the tabs to be pivoted through a horizontal plane and thus operate in the relatively undesirable so-called second mode, in which severing of the frangible bridges is accomplished by making the effective inner diameter of the tamper ring less than that of the diameter of the ring on the container finish. In this mode, as mentioned above, substantially no leverage is obtained, and a much greater degree of unthreading must occur before the bridges are broken.

SUMMARY OF THE INVENTION

Briefly stated, the present invention contemplates the provision of an improved tab construction in which the possibility of the tabs pivoting inwardly to a degree wherein the tabs function in the so-called second mode of operation is completely eliminated. This is accomplished in a first embodiment by locating the pivotal axis of the tabs radially inwardly of the surfaces of the tab which contact a lower surface of the bead on the container finish, so that as the closure is unthreaded, forces transmitted from the bead on the finish to the tabs have only radially outwardly directed components. At the conclusion of the pivotal movement, at which time a planar surface of the tab comes into contact with a planar or frusto-conical surface on the bead on the container, the axially oriented components of the force are transmitted directly to the tamper-indicating ring and serve to break the interconnecting bridges in well-known manner. In another embodiment the cylindrically shaped tamper-indicating ring is formed with an upper member of relatively thin cross section to permit substantially radial expansion and twisting during both application on the container finish, and during removal of the closure from the container. The lower member of the ring is of substantially thicker cross section, and supports relatively rigid tabs at an arcuate upper edge portion thereof. The tabs do not substantially flex or pivot relative to the thicker lower member of the ring, and as a result, the degree of permitted angular displacement through which the tabs may move is limited by the degree of radial expansion and bending of the upper member of the ring, typically no more than thirty degrees above or below a horizontal plane passing through the lower end of the upper member of the closure. Pivoting action thus does not depend upon the effective diameter of the outer surface of the container finish below the tab engaging bead.

BRIEF DESCRIPTION OF THE DRAWINGS

In the drawings, to which reference will be made in the specification, similar reference characters have been employed to designate corresponding parts throughout the several views.

FIG. 9 is an enlarged fragmentary sectional view showing the flexing of the tamper-indicating ring element of the fifth embodiment during application to a container finish.

FIG. 10 is a similar view showing the tamper-indicating ring after application of the closure.

DETAILED DESCRIPTION OF THE DISCLOSED EMBODIMENTS

Figure 1:
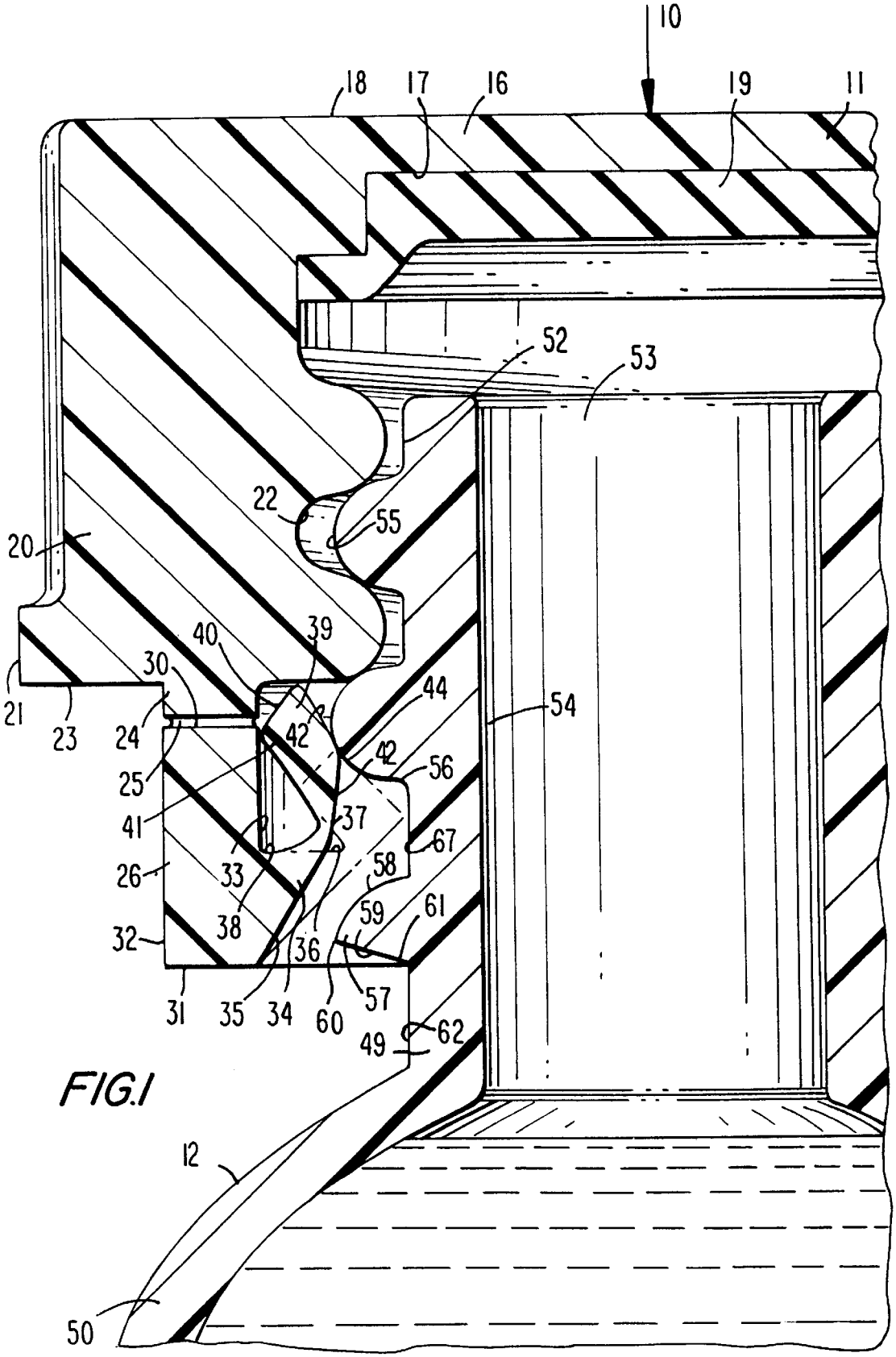
FIG. 1 is a fragmentary schematic sectional view of a first embodiment of the invention, showing the installation of a closure upon a corresponding container finish.

In accordance with the first embodiment of the invention, the device, generally indicated by reference character 10, comprises broadly: a closure element 11 and a container element 12.

The closure element 11 is of generally conventional configuration, and is preferably formed by compression molding using techniques well-known in the art. It includes an end wall 16, bounded by inner and outer surfaces 17 and 18, respectively, the inner surface supporting an optional resilient sealing gasket 19. Surrounding the end wall is a cylindrical side wall 20 bounded by an outer surface 21, a threaded inner surface 22, and a lower surface 23 having a depending flange 24 forming a frangible area 25 which interconnects with a separable tamper-indicating ring 26 which remains on the container finish when the body of the closure is unthreaded.

The tamper-indicating ring 26 includes an upper surface 30, a lower surface 31, an outer surface 32, and an inner surface 33 from which extends a radially inwardly projecting bead 34. The bead is bounded by a lower inclined surface 35, and an upper radially extending surface 36, the surfaces meeting in an area of flexible thin cross section 37. The inner surface 33 and upper surface 36 form an annular recess 38 for reception of a plurality of tabs 39 which are outwardly deflected as the closure element 11 is engaged with the container element 12.

The tabs 39 are relatively inflexible, and are capable only of pivotal movement relative to the ring 26 about an axis through the area of thin cross section 37. In the disclosed first embodiment, the tabs are of quasi-rectangular cross section to include a free end surface 40, first and second side surfaces 41 and 42, as well as a second end surface 43 which communicates with the surface 42 at a rounded edge 44.

The container element 12 is generally conventional, and may be formed as a preform from polyethylene terepthalate (PET) or synthetic resinous materials with comparable properties. It includes a hollow main body 50 from which a cylindrical neck or finish 51 extends. The finish 51 includes an annular end surface 52 bordering an open mouth 53 from which an inner surface 54 extends. A threaded outer surface 55 cooperates with the inner surface of the closure element. Beneath the lowermost convolution 56 thereof is an annular bead 57 which serves to engage the tabs 39 in known manner. The bead includes a rounded upper surface 58 and a frusto-conical lower surface 59. Optionally, the lower surface may lie in a radially extending plane (not illustrated). The surface 59 is bordered by an outer edge 60 and an inner edge 61.

The tabs 39, in relatively unstressed condition occupy an annular recess 62 formed between an upper wall portion 66 of the container and the bead 57.

Operation

As best seen in FIG. 1, the closure is initially engaged upon the container finish by threading or an axially oriented force. During installation, the tabs 39 will be pivoted radially outwardly into the recess 38 as they contact the upper surface 58 until the edge 63 clears the annular edge 64. In some cases, this action is assisted by a radially outward expansion (not shown) of the tamper ring which is of relatively thin cross section above the bead 34.

Figure 2:
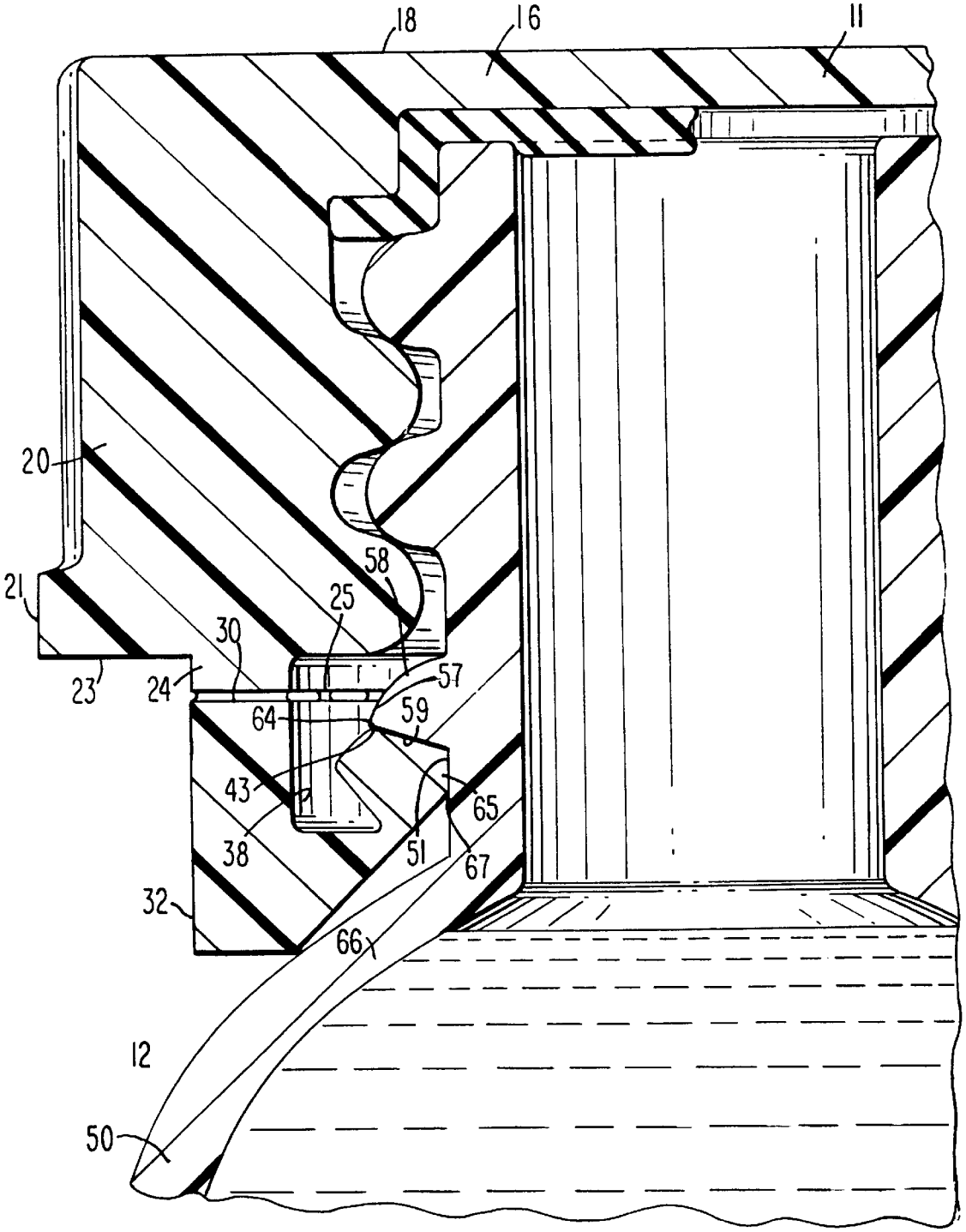
FIG. 2 is a similar fragmentary schematic sectional view showing the closure in installed condition.
Figure 3:
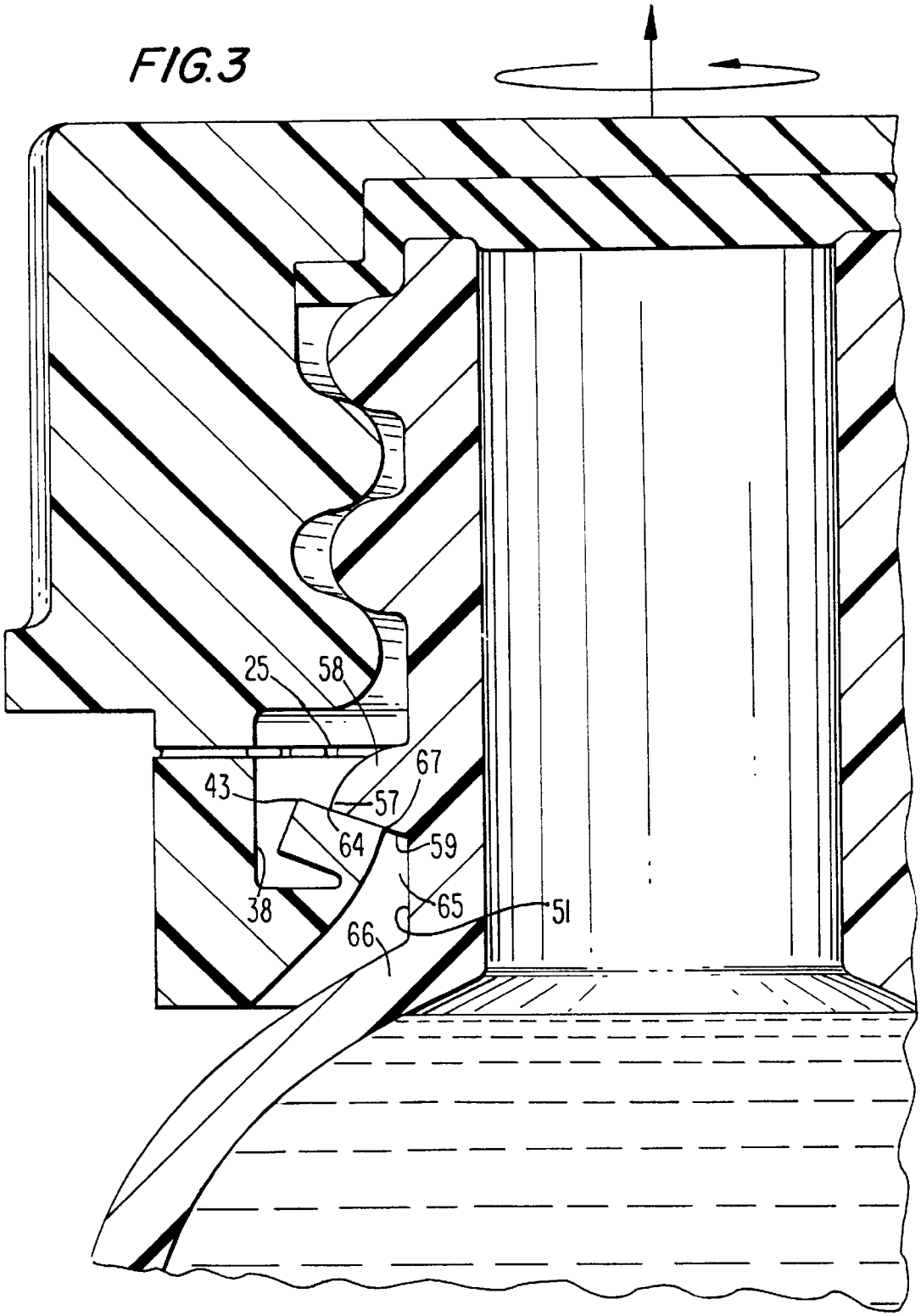
FIG. 3 is a similar fragmentary schematic sectional view showing the position of the partially unthreaded closure just prior to the breaking of frangible bridges interconnecting a dependent tamper ring from the closure body.

Once clear, the tabs will assume a relatively unstressed condition shown in FIG. 2, in which they project into the space 65 between the bead 57 and the upper wall portion 66 of the container body. In this position, the edge 64 contacts the outer surface 55 of the finish to prevent further radially inward movement.

When the closure is unthreaded to open the container, the tabs will be pivoted radially outwardly by contact of the edge 53 with the surface 59. This movement continues until the surface 59 of the bead 57 comes into planar contact with the surface 51, at which point, the camming action ceases. With further unthreading of the closure, the force developed between these surfaces is transmitted to the body of the tamper-indicating ring wherein the axially aligned components of the force effect breakage of the frangible area 25, thus severing the tamper ring which then remains on the container finish. The pivoting of the tabs during this action is in the order of approximately 30 degrees.

It is to be noted that since the area of thin cross section about which the tabs pivot is disposed radially inwardly of the edge 44 at all times, the tab is incapable of pivoting radially inwardly to operate in the so-called "second model", thus assuring a rapid breaking of the frangible area interconnecting the tamper-indicating ring to the body of the closure.

Turning now to the second embodiment of the invention, to avoid needless repetition, certain of the component parts corresponding to those of the first embodiment have been designated by similar reference characters with the additional prefix "1".

In the second embodiment, surfaces 73 and 74 are disposed inwardly of the area of the cross section 76 and conform very closely to the undersurface 77 of the bead on the finish. Surface 72 serves to cam the tab pivotally during the initial engagement of the closure with the finish. In unstressed condition, the meeting of the surfaces 74 and 75 at edge 78 lies in a vertical plane passing through the pivot axis in the area of thin cross section. When the closure is unthreaded, the tab moves with very little, if any, pivotal movement as the edge 80 is in contact with the cylindrical surface 79 of the finish. The vertical movement necessary to break the frangible bridges interconnecting the tamper-evident ring with the body of the closure is thus very short, and the bridges are ruptured almost immediately as the closure starts to unthread.

Turning now to the third embodiment of the invention, again, certain of the component parts corresponding to those of the first embodiment have been designated by similar reference characters with the additional prefix "2".

Figure 4:
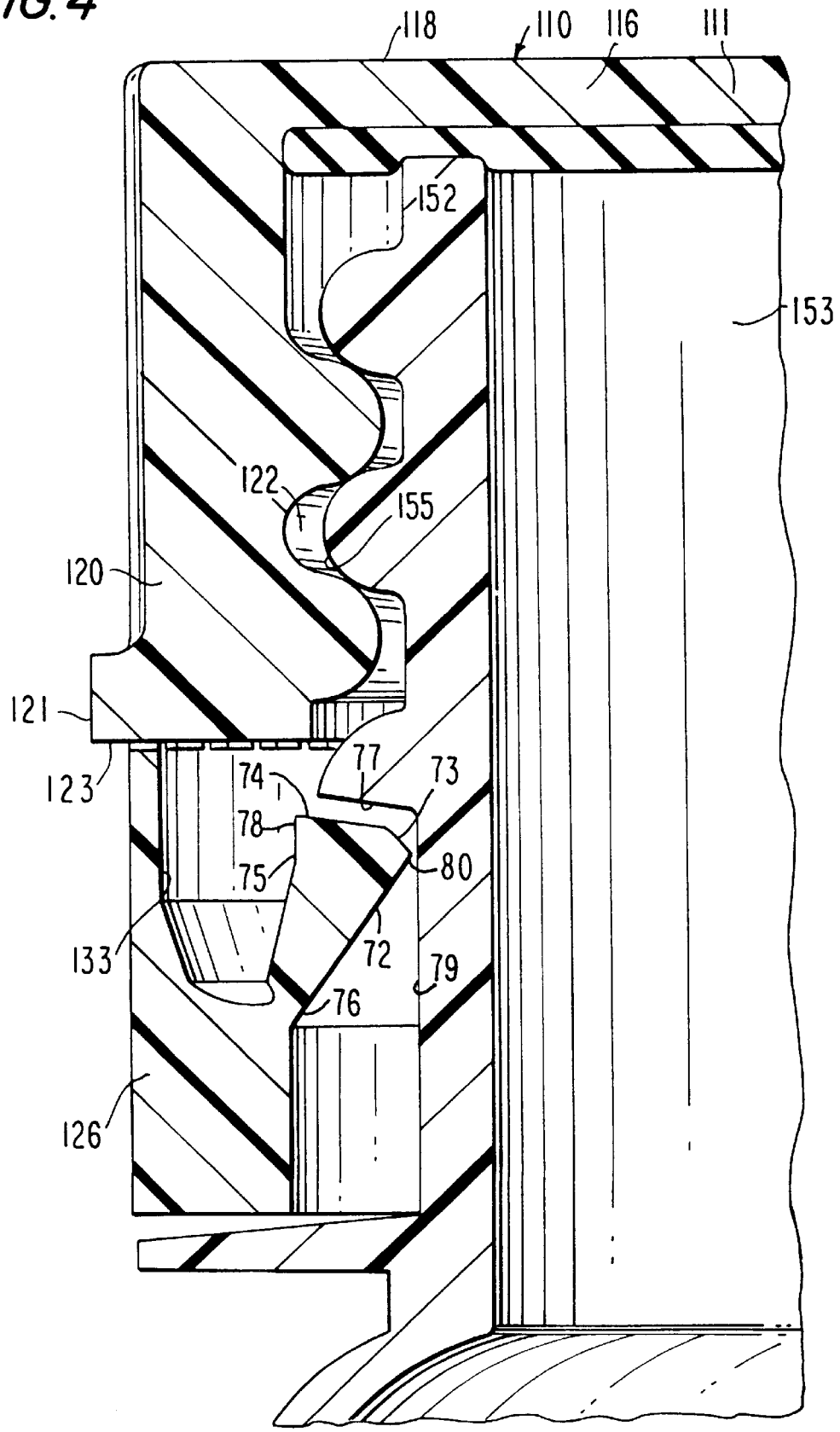
FIG. 4 is a fragmentary schematic sectional view of a second embodiment of the invention.
Figure 5:
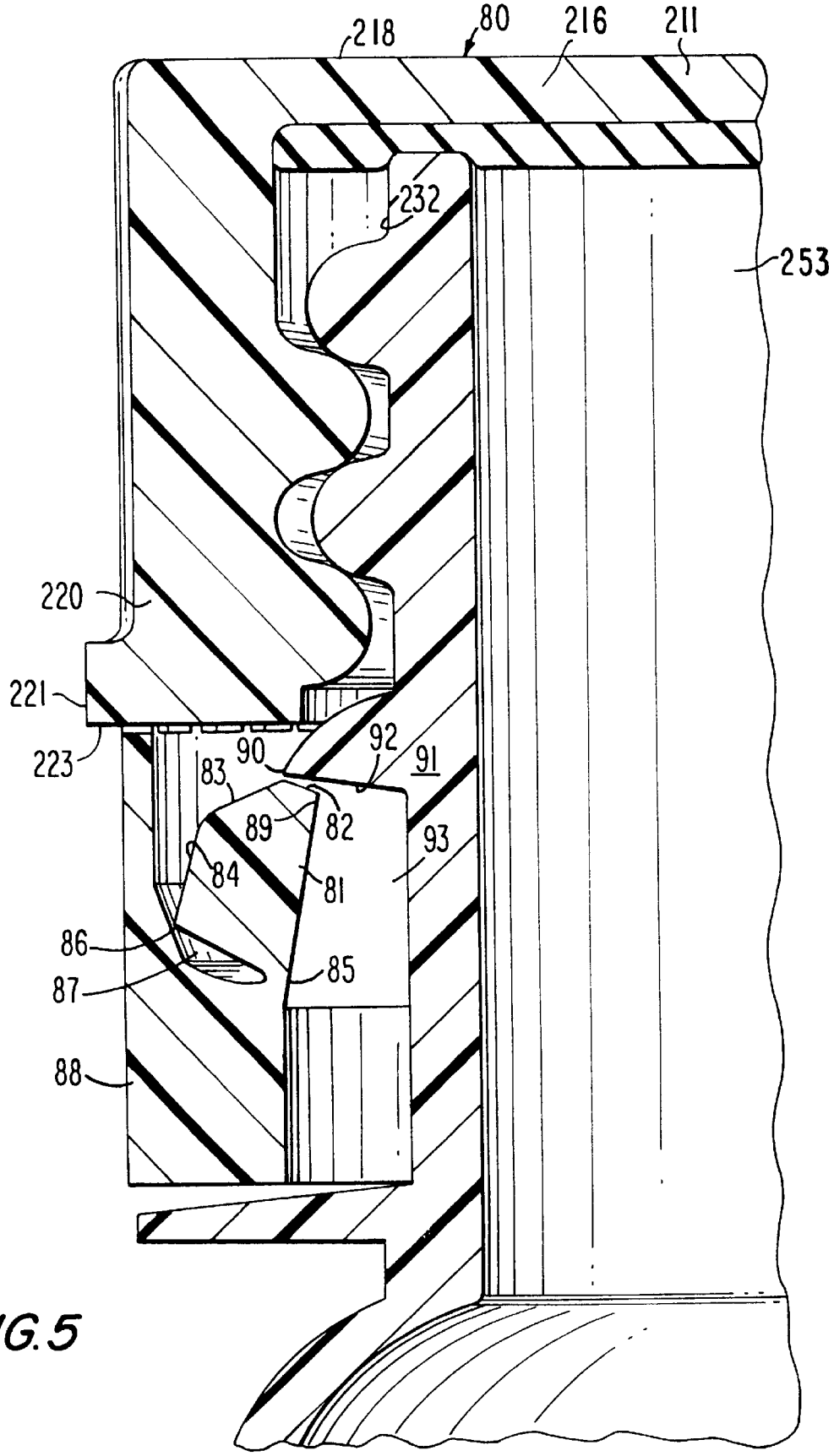
FIG. 5 is a fragmentary schematic sectional view of a third embodiment of the invention.

In the third embodiment, generally indicated by reference character 80, the tab 81 is bounded by surfaces 82, 83, 84 and 85. During installation of the closure, the edge 86 engages the sloping inner surface 87 of the ring 88, whereby the edge 89 under slight outward pressure, clears the edge 90 on the bead 91. The tab returns to unstressed condition as shown, and when the closure is unthreaded, the surface 82 engages the surface 92. Because of the relatively small clearance 93 existing between the tab and the surface of the finish, the tab cannot pivot inwardly in any event substantially past the degree shown in FIG. 4.

Figure 6:
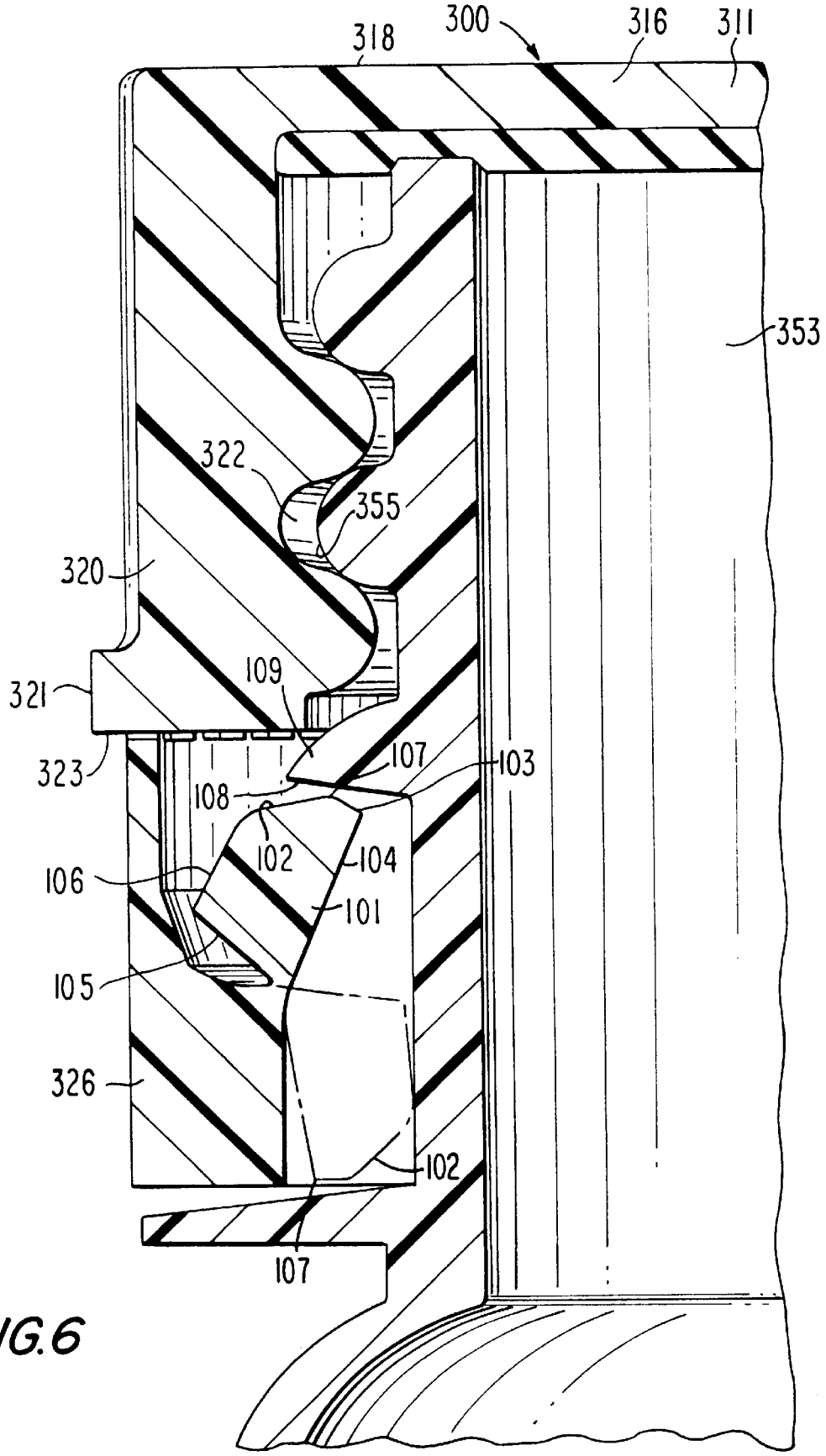
FIG. 6 is a fragmentary schematic sectional view of a fourth embodiment of the invention.
Figure 7:
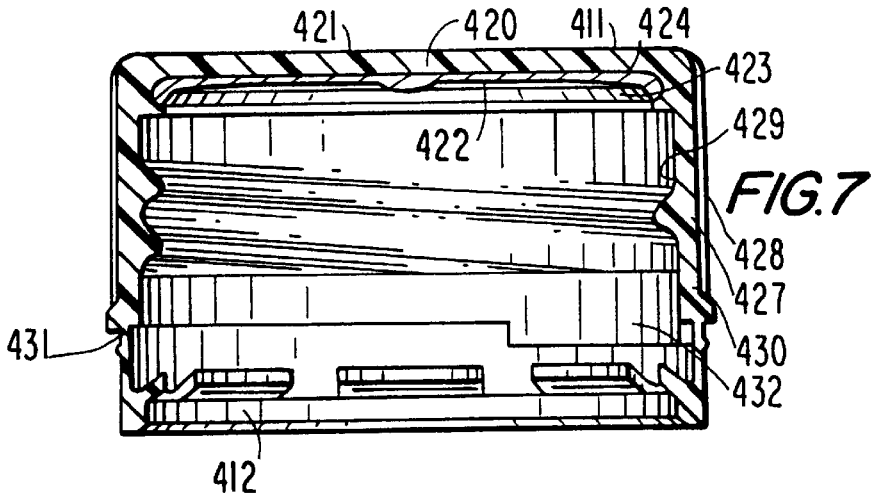
FIG. 7 is a schematic vertical central sectional view of a fifth embodiment of the invention.
Figure 8:
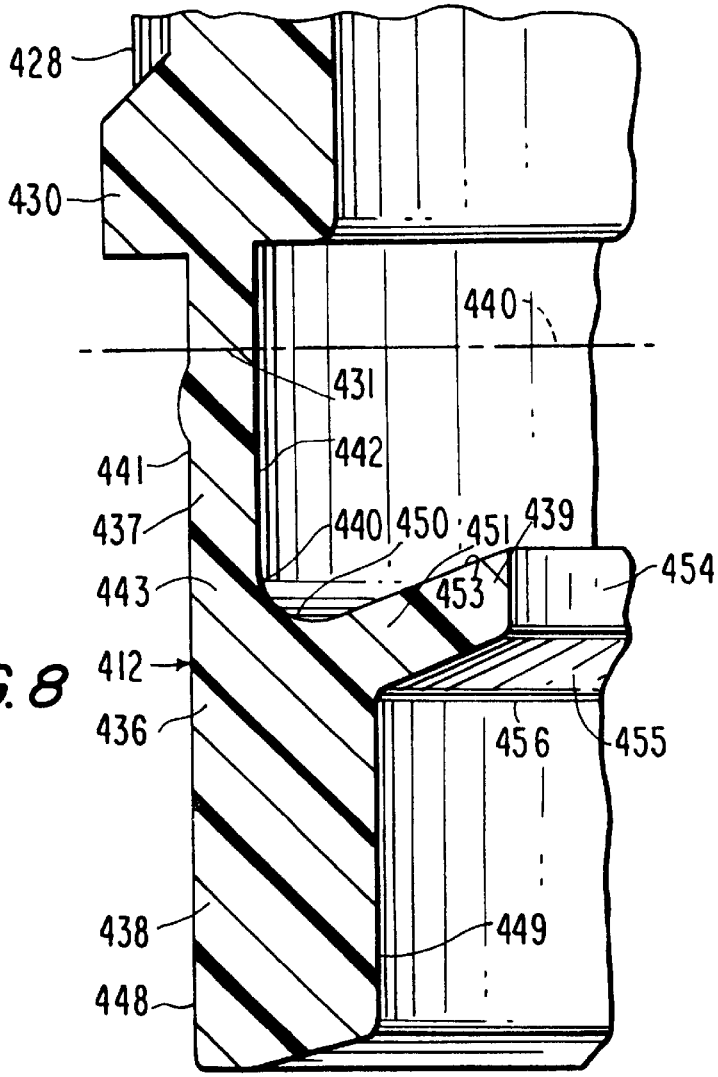
FIG. 8 is an enlarged schematic sectional view corresponding to the lower left hand portion of FIG. 7.

Turning now to the fourth embodiment of the invention, shown in FIG. 6, again, certain of the parts corresponding to those of the first embodiment have been designated by similar reference characters with the additional prefix "3".

The fourth embodiment is particularly suited for use with that type of closure incorporating a tamper indicating ring which splits before all of the frangible interconnecting bridges are severed, to enable the tamper-indicating ring to remain attached to the closure during initial removal, whereafter it may be manually disconnected by the user. This type of closure is preferred where the container is intended for recycling, and is often made of a material different from that from which the closure is made.

In the fourth embodiment, generally indicated by reference character 300, the tab 101 is bounded by five surfaces, 102, 103, 104, 105, and 106. An edge 107 contacts the undersurface 108 of the bead 109 and is cammed inwardly with unthreading movement of the cap. This initial pivoting movement is quite rapid owing to the relative angle of the surface 102, and ultimately results in the tab assuming the position shown in dashed lines. This is not, however, operation in the so-called "second mode". As the tab pivots inwardly, it generates a radially outward force on the tamper-indicating ring before it generates a force parallel to the axis of the closure. Thus, it quickly ruptures or splits the tamper-indicating ring within its own plane, and rupture of some of the bridges occurs subsequently as the ring, in split condition, is forced over the bead on the finish.

Turning now to the fifth embodiment of the invention, this embodiment, generally indicated by reference character 410, comprises broadly, a cap element 411, and a depending tamper-indicating ring element 412.

The cap element 411 is typically compression molded, and includes an end wall 420 bounded by an outer surface 421 and an inner surface 422 defining a recess 423 supporting a synthetic resinous liner 424, the details of which are well-known in the art. A cylindrical side wall 427 includes a knurled outer surface 428 as well as a threaded inner surface 429 which extends to an unthreaded skirt portion 430. A plurality of frangible interconnecting bridges 431 and a non-frangible bridge 432 interconnect the cap element 411 with the ring element 412.

The ring element 412 is of circular configuration, and includes a cylindrical wall 436 extending below the frangible bridges 431, having an upper member 437 of relatively thin cross section, and a lower member 438 of relatively thicker cross section which supports a plurality of tabs 439 at an upper edge surface 440.

The upper member 437 includes an upper edge surface 440, the outer surface 441 and an inner surface 442 which extends to a lower pivot area 443 which provides most of the flexing action required during installation of the closure. During installation, the flexing action necessary to clear the bead on the container is best understood from a consideration of FIGS. 9 and 10.

The lower member 438 includes an outer surface 448 which is a continuation of the surface 441, an inner surface 449, and a curved upper surface 450 which extends to an inner corner 451 which supports the relatively rigid tabs 439. The tabs include an upper surface 453, and an inner surface 454, and a lower surface 455 which extends to a lower edge 456.

Normally, in the case of a commonly used 28 mm closure, the thickness of the upper member 437 will range from 0.018 to 0.020 inches. The thickness of the tabs is preferably in the order of 0.030 inches. The thickness of the lower member 38 is preferably in the order of 0.050 inches, and the height of the lower member, as measured from the lower edge 56 to a lower edge 59, is in the order of 0.070 to 0.100 inches, to insure that most of the flexing required will take place within the body of the upper member 437.

Figure 11:
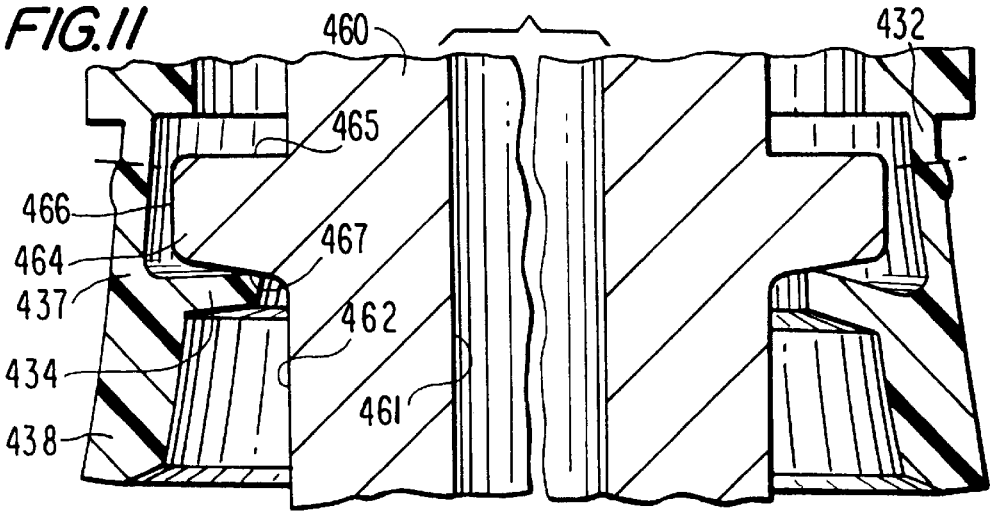
FIG. 11 is a similar view showing the flexing of the tamper-indicating ring during a first stage of removal of the closure.
Figure 12:
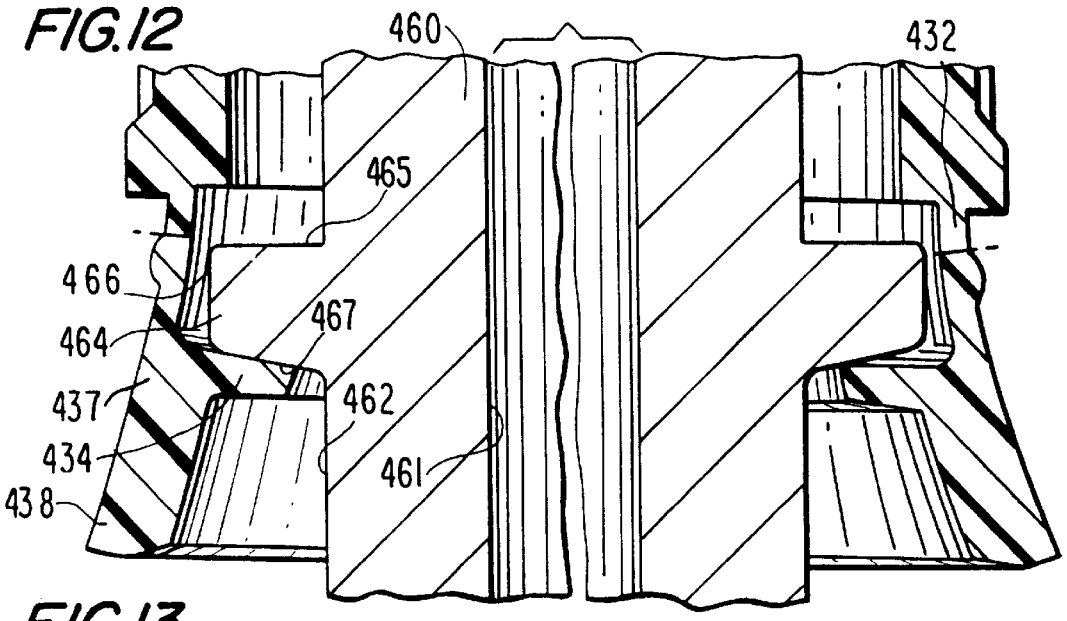
FIG. 12 is a similar view showing a further stage of removal of the closure.
Figure 13:
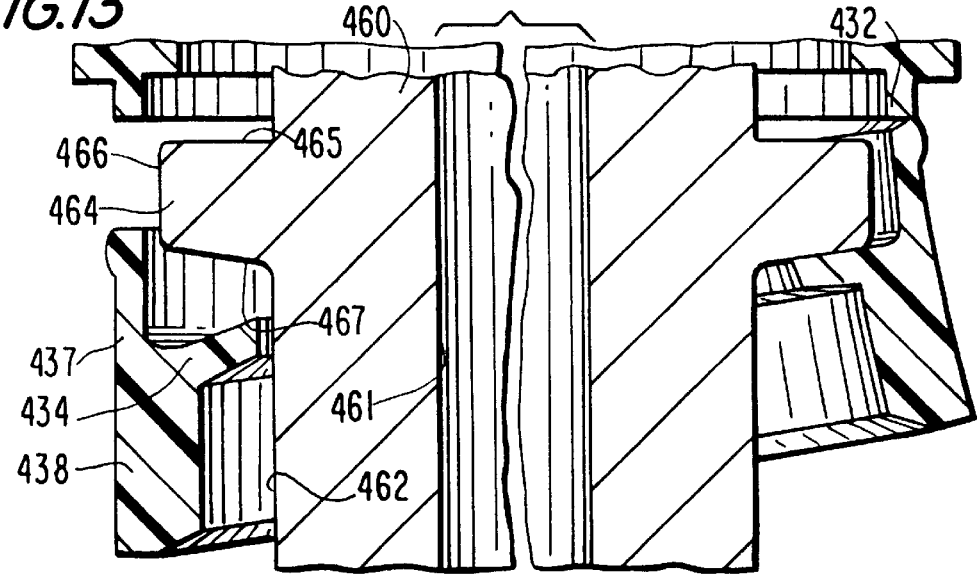
FIG. 13 is a similar view showing the breaking of the frangible bridges interconnecting the tamper-indicating ring and the cap portion of the closure.

The behavior of the device during removal from a container finish is illustrated in FIGS. 11, 12, and 13. The finish, generally indicated by reference character 460, includes an inner surface 461 and an outer surface 462, the surfaces 461 and 462 extending upwardly to define a mouth of the container (not shown). An outwardly extending bead 464 projects from the surface 462 and is bounded by an upper surface 465, an outer surface 466, and a lower surface 467. As the closure is unthreaded, the tabs will engage and ultimately conform to the shape of the lower surface 467 of the finish (FIG. 12). However, due to the inherent rigidity of the tabs and the lower member, the degree of flexing does not depend upon the diameter of the outer cylindrical surface of the finish beneath the bead, which is not contacted and thus, the tabs function properly, even if the outer surface of the finish is undersized. Once the interconnecting bridges 431 are broken, the tamper-indicating ring assumes the condition shown in FIG. 13, wherein the areas supported by the frangible bridges 431 is shown at the left-hand portion of the figure, with the right-hand portion of the figure showing the non-frangible bridge 432.

I claim:

1. In a combination container having a principal longitudinal axis and a threaded closure therefor, said closure having an end wall, a cylindrical, side wall and a tamper-indicating ring having an area frangibly interconnected to an annular edge surface of said side wall of said closure, said tamper-indicating ring having a plurality of radially inwardly extending tabs pivotally interconnected to an inner surface of said ring, said container having a cylindrical finish having a threaded outer surface and an annular tab-engaging bead thereon, whereby the unthreading of said closure from said finish serves to disconnect said tamper-indicating ring from said side wall of said closure, the improvement comprising: said bead on said finish having a lower surface disposed at an angle with respect to said principal axis of said finish, said surface extending radially outwardly to an arcuate edge; said tamper-evident ring having an inner arcuate surface and a radially inwardly directed bead of relatively thick cross section, said bead having an upper radially-oriented surface and a lower angularly-oriented surface, said upper and lower surface meeting in an area of relatively thin cross section; said tabs being of thicker cross section relative to said area, and being pivotally interconnected at said area of thin cross section for radially inward and outward movement about an axis through said area of thin cross section, said tabs having a planar surface and an edge bordering said planar surface; said edge being positioned, when said tabs are in relatively unstressed condition adjacent a lower surface of said bead on said container finish to selectively engage said planar surface in cammed relation upon the unthreading of said closure from said finish, to result in radial movement of said tabs in an area between said area of thin cross section and said annular edge surface of said side wall to a point where said planar surface of said tabs are in contact with said lower surface of said bead, further unthreading of said closure resulting in transmission of an axially directed component of force to said tamper-indicating ring to break the frangible interconnection between said tamper-indicating ring and said annular edge surface of said body of said closure.

2. The improvement in accordance with claim 1, in which when said tabs are in relatively unstressed condition, said edge is positioned radially outwardly of said area of thin cross section.

3. The improvement in accordance with claim 1, in which said surface of said bead on said container lies in a conical angle of approximately 120 degrees relative to a principal axis of said closure.

4. The improvement in accordance with claim 1, in which said tabs pivot outwardly during opening of said closure through an arc of about 30 degrees.

5. The improvement in accordance with claim 1, in which when said tabs are in relatively unstressed condition, said edge thereof is positioned in a vertical plane passing substantially through said area of thin cross section.

6. The improvement in claim 5, in which said tab is of sufficient length to prevent it from pivoting substantially inwardly from its relatively unstressed position by contact with a surface of said finish, caused by contact of a free edge of said tabs with an outer surface of said container finish.

7. The improvement in accordance with claim 1, in which said tab has a radially outwardly disposed surface which contacts an inner surface of said tamper ring when in relatively unstressed condition.

8. The improvement in accordance with claim 7, in which said tab is of sufficient length to prevent it from pivoting substantially inwardly from its relatively unstressed position, caused by contact by a free end of said tabs with said outer surface of said container finish.

9. The improvement in accordance with claim 1, in which said tab includes an upwardly facing camming surface developing a radially outwardly directed component of force against said tamper-indicating ring to split said ring prior to breaking said frangible area.

10. In a combination container and threaded closure therefor, said closure having a tamper-indicating ring having an area frangibly interconnected to an annular edge surface of the body of said closure, said tamper-indicating ring having a plurality of radially inwardly extending tabs pivotally interconnected at an area of thin cross section to an inner surface of said ring, said container having a cylindrical finish having a principal longitudinal axis, a threaded outer surface and an annular tab-engaging bead thereon, whereby the unthreading of said closure from said finish serves to disconnect said tamper-indicating ring from the body of said closure, the improvement comprising: said plurality of tabs having at least one surface thereon positioned to engage a lower surface on said bead in camming relation upon the unthreading of said closure, the camming relation being such that the tabs are moved radially outwardly as unthreading of said closure progresses, in an area between said area of thin cross section and said body of said closure.

11. The improvement in accordance with claim 10, said tabs each having a second surface thereon which engages said bead on said finish during installation of said closure on said finish, in which engagement of said second surface serves to cam said tabs radially outwardly to enable said tabs to clear said bead.

12. The improvement in accordance with claim 10 in which said tamper-indicating ring includes an upper portion of relatively thin cross section, and a lower portion of relatively thicker cross section, said tabs being-interconnected to said ring substantially at the juncture of said upper and lower portions, said upper portion forming a recess into which said tabs may be moved during engagement of said closure.

13. The improvement in accordance with claim 10 in which pivotal movement of said tabs is limited to an arc of 30 degrees.

* * * * *